US006247835B1

(12) United States Patent
Taniuchi

(10) Patent No.: US 6,247,835 B1
(45) Date of Patent: Jun. 19, 2001

(54) VEHICLE HEADLIGHT

(75) Inventor: Hitoshi Taniuchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/362,211

(22) Filed: Jul. 28, 1999

(30) Foreign Application Priority Data

Jul. 29, 1998 (JP) ..... 10-214090

(51) Int. Cl.[7] ..... F21V 19/02; F21V 21/14

(52) U.S. Cl. ..... 362/524; 362/508; 362/526; 362/286; 362/467; 362/288; 362/274

(58) Field of Search ..... 362/271, 274, 362/288, 465, 466, 467, 286, 508, 524, 526

(56) References Cited

U.S. PATENT DOCUMENTS 5,911,502 * 6/1999 Zillgitt et al. ..... 362/508

FOREIGN PATENT DOCUMENTS 4435 507A1 4/1996 (DE) .
10-92208 4/1998 (JP) .
10-283804 10/1998 (JP) .

* cited by examiner

*Primary Examiner*—Sandra O'Shea
*Assistant Examiner*—Ali Alavi
(74) *Attorney, Agent, or Firm*—Morgan, Lewis & Bockius LLP

(57) ABSTRACT

A vehicle headlight includes a driving unit capable of repeatedly switching the headlight's light distribution pattern between a by-passing mode and a traveling mode by moving an element committed to the formation of the light distribution patterns. The driving unit includes a first spring for biasing a positioning element in a by-passing mode, a meshing gear for moving the positioning element to a traveling mode position against the bias of the first spring, a motor which supplies power to drive the meshing gear, a second spring biased in an engaging direction of the meshing gear, a solenoid for releasing the engagement of the meshing gear with a second gear against the pulling power of the second spring. The disclosed headlight enables size reduction of the driving unit, and provides improved reliability if the motor malfunctions.

12 Claims, 3 Drawing Sheets

VEHICLE HEADLIGHT

This invention claims the benefit of Japanese Patent Application No. 10-214090, filed on Jul. 29, 1998, which is hereby incorporated by reference.

BACKGROUND OF THE INVENTION

1. Field of the Invention

The invention relates to a headlight or lamp used in an automobile or other vehicle, and more particularly to a configuration of the headlight in which a single light source, such as a discharge lamp, is incorporated. The single light source headlight is capable of changing light distribution patterns between a by-passing mode when the automobile is passing another vehicle and a traveling mode when the automobile is traveling straight ahead. Light distribution patterns are changed by changing a position of a part in the headlight affecting formation of light distribution patterns, such as a light source or a reflector, in accordance with the driver's operations.

2. Discussion of the Related Art

FIG. 6 illustrates a conventional automobile headlight 90. The headlight 90 includes a light source 91, a reflector 94 having an aperture, a light source mounting plate 92 having a fixed end and a movable end, a solenoid 93 connected to the movable end portion and capable of moving the light source mounting plate 92 to traverse a circular arc with the center located at the fixed end, and a return spring 95 which is also connected to the movable end portion to return the light source mounting plate 92 to a previous position when the solenoid 93 is turned off. Light distribution patterns of the headlight 90 can be repeatedly switched between a by-passing mode and a traveling mode by changing the position of light source 91 relative to the reflector 94 in accordance with the movement of the light source mounting plate 92 driven by solenoid 93.

Solenoid 93 and the return spring 95 produce predetermined forces in opposite directions to each other in order to pull the light source mounting plate 92 toward themselves, respectively. Since in current traffic environments there are more situations which require a headlight to be in by-passing mode, the standard position of the light source 91 is in the by-passing mode. Solenoid 93 is activated only during the traveling mode. When the headlight is switched from the traveling mode to the by-passing mode, the solenoid 93 is turned off, and the light source mounting plate 92 returns to its standard, original position by force of the return spring 95.

FIG. 7 illustrates a construction of another conventional automobile headlight 90. The headlight 90 includes a light source 91, a reflector 94, a light source mounting plate 92, a nut 96 connected to the light source mounting plate 92, a bolt 98 which screws through the nut 96, and a motor 97 corresponding to a head of the bolt 98 and connected to the bolt 98. In this configuration, the light source supporting plate 92 is not required to have a fixed end acting as a center for partial rotation thereabout. A return spring 95 is also not required if the motor 97 is capable of repeatedly screwing in or out a predetermined portion of the bolt 98 through the nut 98.

The conventional automobile headlight 90 as shown in FIG. 6 has the following problems. First, when the light source mounting plate 92 is moved from its by-passing position to its traveling position, the solenoid 93 requires high power because the light source mounting plate 92 is driven against the fairly strong bias of the return spring 95.

The return spring 95 must maintain the light source mounting plate 92 in its original position while surviving the shock and vibration caused by travel of the car. Accordingly, the return spring 95 must deliver a fairly strong pulling force toward the reflector 94 even when the light source 91 is in its original position. Second, the solenoid 93 must be relatively large in size to produce the continuous power supply necessary when the light source mounting plate 92 is in the traveling position. The continuous power supply can cause a rapid temperature rise in the solenoid 92 and requires the solenoid 92 to be sized to withstand such a temperature rise.

The automobile headlight 90 as shown in FIG. 7 enables reduction of size and power consumption as compared to the headlight 90 shown in FIG. 6 since the driving force of the motor 97 is transmitted to the bolt 98 and the nut 96 and because the motor 97 can be turned off after the light source mounting plate 92 reaches a desired position. The light source mounting plate 92 is not required to have a fixed end acting as a center for partial rotation thereabout. Additionally, if the motor 97 can perform reverse rotation, a return spring 95 is not required. However, the automobile headlight 90 still has at least the following problems. If the motor 97 malfunctions, the light source mounting plate 92 may become fixed and unmovable in a position at which the malfunction of the motor 97 occurred. Accordingly, the headlight 90 may operate in an incorrect mode and/or incorrectly operate in between the traveling and by-pass modes.

SUMMARY OF THE INVENTION

The invention is directed to a vehicle lamp that substantially obviates one or more of the above problems due to the limitations and disadvantages of the related art.

An object of the invention is to provide a vehicle headlight in which lower power consumption and a reduction in size are accomplished.

Another object of the invention is to provide a more reliable vehicle headlight in which the light source is switched to the by-passing mode in the event a malfunction occurs in the motor or driving unit of the headlight.

The above objects are achieved by providing an automobile lamp capable of repeatedly switching its light distribution pattern between a by-passing mode and a traveling mode and including a drive unit including a positioning element committed to the formation of light distribution patterns, a first biasing member which maintains the positioning element in a by-passing mode via biasing force, a meshing gear for moving the positioning element to a traveling mode position against the biasing force of the first biasing member and being selectively engageable with the positioning element, a motor located on the drive unit and which supplies power to drive the meshing gear, a second biasing member which forces the meshing gear in an engaging direction, and a solenoid located on the drive unit and which applies force to the meshing gear against the bias of the second biasing member.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to the preferred embodiments of the invention.

Wherever possible, the same reference numbers will be used throughout the drawings to refer to the same or like parts.

Figure 1:
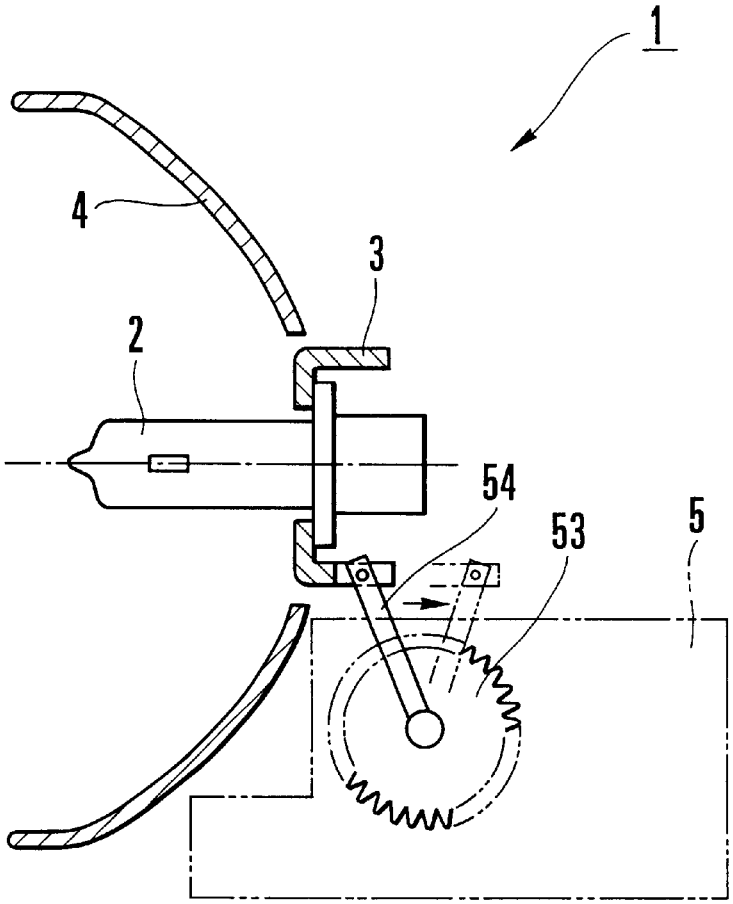
FIG. 1 illustrates a schematic cross sectional view of a preferred embodiment of the invention.
Figure 2:
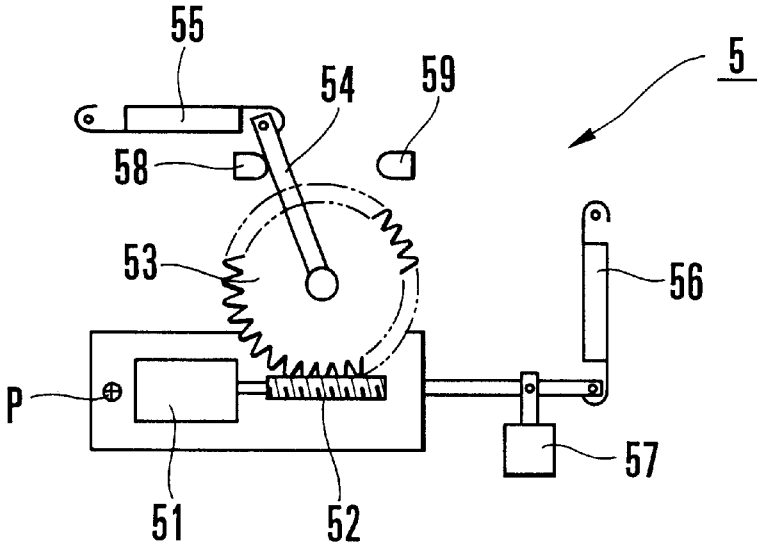
FIG. 2 illustrates a diagram showing the configuration of a driving unit for a preferred embodiment of the invention.

FIG. 1 illustrates schematically a preferred embodiment of the invention. The automobile headlight 1 includes a light source 2, a reflector 4, a light source mounting plate 3, and a driving unit 5 for changing the position of the light source 2 and the light source mounting plate 3 relative to the reflector 4 in order to switch the light distribution pattern between the by-passing mode and the traveling mode. As illustrated in FIG. 2, the driving unit 5 can include a motor 51 which supplies power to drive a meshing gear system. The driving unit 5 can also include: a worm gear 52 rotated by the motor 51, a wheel gear 53 that selectively meshes with the worm gear 52, a lever 54 transferring the rotational movement in accordance with the rotation of the wheel gear 53 to the light source mounting plate 3, a first spring 55 connected to the lever 54 and biased to provide a pulling force for moving the light source mounting plate 3 to the by-passing mode position, a second spring 56 hooked on a bar connected to the worm gear 52 and biased to provide a pulling force in an engaging direction of the worm gear 52 and the wheel gear 53, and a solenoid 57 for selectively releasing the engagement of the worm gear 52 and the wheel gear 53 against the pulling force of the second spring 56 when the solenoid 57 is driven. The driving unit 5 can further include a by-passing limit switch 58 and a traveling limit switch 59. When the lever 54 reaches either the by-passing limit switch 58 or the traveling switch 59, the motor 51 is turned off.

Figure 3:
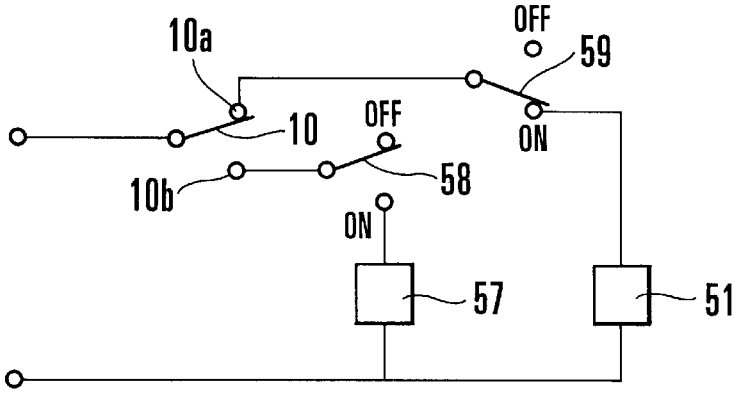
FIG. 3 illustrates a wiring diagram of the driving unit for a preferred embodiment of the invention.

FIG. 3 illustrates a wiring diagram for motor 51 and solenoid 57. The wiring diagram includes the motor 51, solenoid 57, traveling limit switch 59, by-passing limit switch 58, and a light distribution pattern changing switch 10. The switch 10 includes traveling terminal 10*a* for the traveling mode and a by-passing terminal 10*b* for the by-passing mode. The motor 51 is connected through the traveling limit switch 59 to the traveling terminal 10*a* and solenoid 57 is connected through the by-passing limit switch 58 to the by-passing terminal 10*b*.

The light source 2 can be switched from the by-passing mode to the traveling mode by closing the traveling terminal 10*a* at the discretion of the driver. Closing the traveling terminal 10*a* causes the motor 51 to rotate and moves the lever 54 toward the traveling position. When the lever 54 reaches the traveling limit switch 59, the limit switch 59 stops operation of the motor 51. At this time, the light source 2 is in the traveling position to provide a traveling light distribution pattern for the automobile headlight 1.

When the light distribution pattern changing switch 10 is switched from the traveling terminal 10*a* to the by-passing terminal 10*b*, the solenoid 57 is activated. Upon activation of solenoid 57, a base element driving device rotates against the return force of the second spring 56 about a fulcrum P. The base element driving device can be defined by the motor 51 and worm gear 52 or can include a separate structure upon which the motor 51 and worm gear 53 are mounted. Rotation of the base element driving device causes worm gear 52 to disengage from the wheel gear 53, thereby allowing the wheel gear 53 to rotate freely. Lever 54 is then moved toward the by-passing limit switch 58 by the first spring 55. When the lever 54 reaches the by-passing limit switch 58, the solenoid 57 is deactivated. In this by-passing mode the worm gear 52 and the wheel gear 53 mesh with each other to fix the light source 2 and light source mounting plate 3 in their by-passing positions.

The operational advantage of the automobile headlight 1 according to the preferred embodiment of the invention will now be described.

First, the automobile headlight 1 provides improved reliability by assuring that the headlight switches to the by-passing mode from a suspended traveling mode in the instance that the motor 51 malfunctions and becomes unable to rotate the wheel gear 53. Accordingly, even if the movement of the lever 54 stops in between the by-passing limit switch 58 and the traveling limit switch 59, the headlight will still be able to return to the by-passing mode when the driver switches the light distribution pattern to the by-passing mode. The headlight returns to the by-passing mode regardless of whether the motor 51 malfunctions due to the fact that the worm gear 52 and the wheel gear 53 release in accordance with the driver's changing the switch to the by-passing terminal 10*b*. Additionally, the engagement of the worm gear 52 and the wheel gear 53 after the lever 54 reaches the traveling limit switch 59 is certain to occur because the engagement is dependent on the bias of the second spring 56. Second, as described above, the release and engagement of the worm gear 52 and wheel gear 53 are not dependent on the operation of the motor 51. Therefore, the first spring 55 is not required to have a strong pulling force other than to the extent that it can maintain the light source mounting plate 3 in position while surviving strong shock or vibration caused by driving conditions. It is sufficient for the first spring 55 to have only the necessary pulling force for moving the light source mounting plate 3 to its by-passing mode position. Accordingly, the motor 51 is not required to have large driving power and the automobile headlight 1 can be reduced in size. Third, the wiring diagram of the motor 51 is extremely simple as compared to the conventional motor 97. The conventional motor 97 is required to have a mechanism for reversed rotation because it is used for light distribution pattern changes from both the by-passing mode to traveling mode and from the traveling mode to by-passing mode. In the automobile headlight 1, the motor 51 is not required to have a mechanism for reversed rotation. Fourth, the solenoid 57 is also smaller than the conventional solenoid 93. Solenoid 57 is operated for only a short period during which the light source 2 is moved from the traveling position to the by-passing position by the bias force of the first spring 55. Additionally, power required for the solenoid 57 is small because it is only required to release the engagement of the worm gear 52 and the wheel gear 53. Therefore, size reduction of the entire automobile headlight can be achieved without resulting in an overheating problem.

Figure 4:
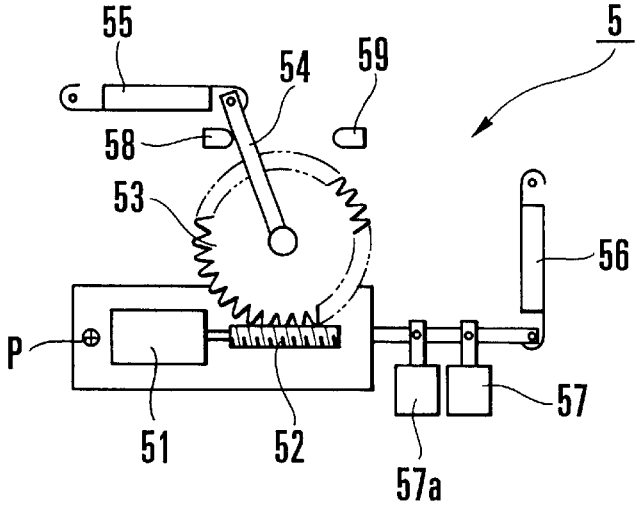
FIG. 4 illustrates a diagram showing a schematic view of a driving unit for another preferred embodiment of the invention.

FIG. 4 illustrates a schematic view of the driving unit for another preferred embodiment of the invention. The driving unit 5 shown in FIG. 4 has an emergency solenoid 57*a*. The preferred embodiment illustrated in FIG. 2 provides a headlight that prevents malfunctioning of the headlight when a malfunction occurs in the motor 51. In the preferred embodiment shown in FIG. 4, the emergency solenoid 57*a* covers the case in which a malfunction occurs in the solenoid 57. When the solenoid 57 malfunctions, the emergency solenoid 57*a* is driven in accordance with a signal from a button or switch that can be located near the driver's seat. Thus, movement of the lever 54 can continue until the lever 54 reaches the limit switch 58 for by-passing.

Figure 5:
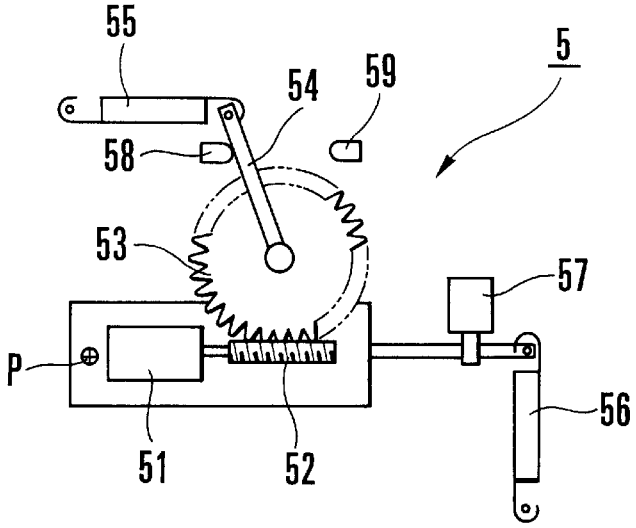
FIG. 5 illustrates a diagram showing a schematic view of a driving unit for another preferred embodiment of the invention.
Figure 6:
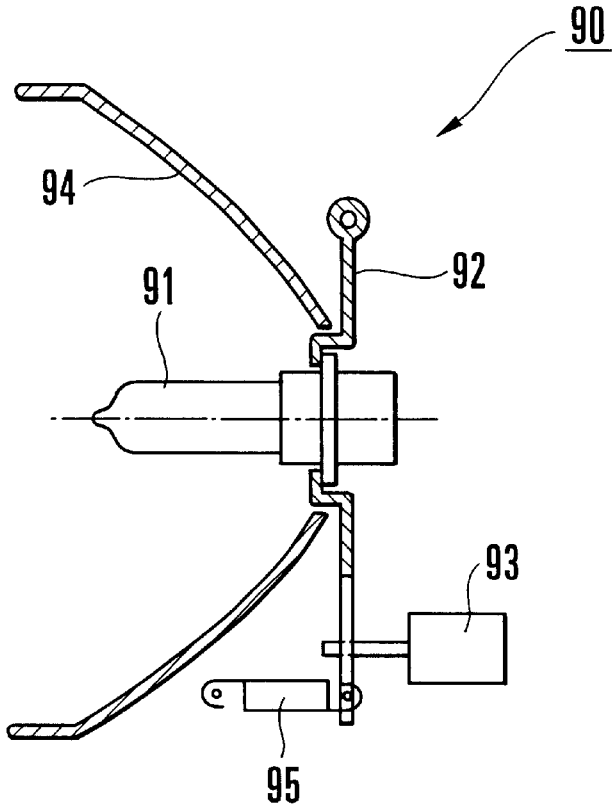
FIG. 6 RELATED ART
FIG. 6 illustrates a schematic cross sectional view of a conventional automobile headlight.
Figure 7:
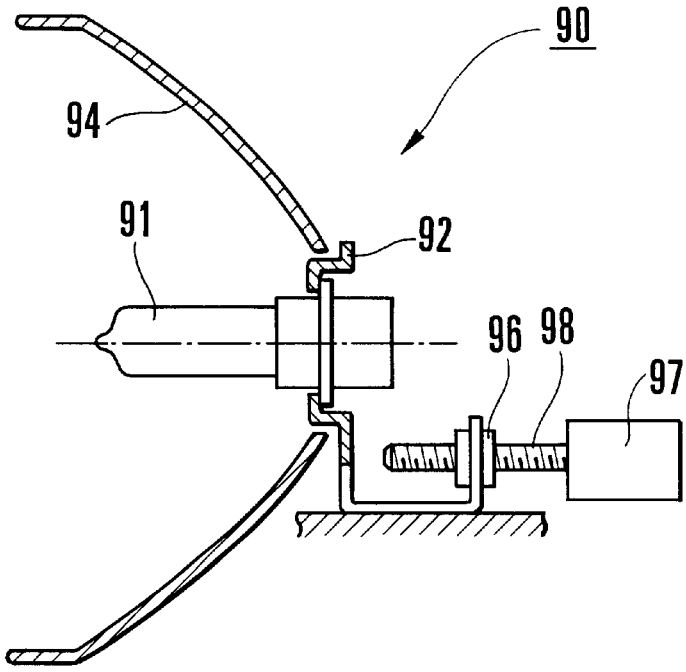
FIG. 7 RELATED ART
FIG. 7 illustrates a schematic cross sectional view of another conventional automobile headlight.

FIG. 5 illustrates schematically the driving unit of another preferred embodiment of the invention. In this embodiment, the second spring 56 is biased toward a direction for releasing the engagement of the worm gear 52 and the wheel gear 53. Solenoid 57 is driven to mesh the worm gear 52 and the wheel gear 53 against the pulling force of the second spring 56. This embodiment provides improved reliability because the engagement of the worm gear 52 and the wheel gear 53 is automatically released by the pulling force of the second spring 56 when a malfunction, such as an electrical short, occurs in the solenoid 57. However, as compared with the previously described preferred embodiments, power consumption increases in the preferred embodiment of FIG. 5 because electric power must be continuously supplied to the solenoid 57 during the traveling mode.

The operational advantages of all preferred embodiments are substantially equal. Selection of which embodiment to use depends on design requirements such as vehicle type, cost, or technical requirements.

It will be apparent to those skilled in the art that various changes and modifications can be made to the disclosed invention without departing from the spirit and scope thereof. For example, many different types of gears other than worm and wheel gears can be used in accordance with the invention. Biasing members other than springs, such as elastic connectors, can also be used in accordance with the invention. In addition, a solenoid connected to a rack and pinion gear system could be used in place of the motor disclosed in the preferred embodiments and the solenoids could be replaced with other known linear actuation devices. Thus, it is intended that the invention cover the modifications and variations of this invention provided they come within the scope of the appended claims and their equivalents.

What is claimed is:

1. A vehicle lamp capable of repeatedly switching its light distribution pattern between a by-passing mode and a traveling mode, comprising:

a drive unit including a positioning element committed to the formation of light distribution patterns;

a first biasing member which maintains the positioning element in a by-passing mode via biasing force;

a meshing gear for moving the positioning element to a traveling mode position against the biasing force of the first biasing member and being selectively engageable with the positioning element;

a motor located on the drive unit and which supplies power to drive the meshing gear;

a second biasing member which urges the meshing gear into engagement with the positioning element; and a solenoid located on the drive unit and which applies force to the meshing gear against the bias of the second biasing member.

2. A lamp capable of repeatedly switching its light distribution pattern between a by-passing mode and a traveling mode, comprising:

a light source located adjacent a light source mounting plate;

a reflector adjacent the light source;

a driving unit located adjacent the light source, wherein the driving unit includes:

a lever having a first end and a second end;

a first biasing member connected to the first end of the lever to bias the lever in a by-passing mode position;

a wheel gear connected to the second end of the lever;

a by-passing limit switch for stopping movement of the lever in the by-passing mode position;

a traveling limit switch for stopping movement of the lever in a traveling mode position;

a meshing gear selectively engageable with the wheel gear for moving the lever to the traveling mode position against the bias of the first biasing member;

a motor connected to the meshing gear and supplying power to drive the meshing gear;

a second biasing member located on the drive unit to bias the meshing gear into engagement with the wheel gear;

a first solenoid located on the drive unit for moving the meshing gear against the bias of the second biasing member; and a base structure including the motor and the meshing gear at whose end portion the second biasing member and the first solenoid are connected.

3. The lamp as claimed in claim 2, wherein the driving unit includes an emergency solenoid capable of being driven when the first solenoid malfunctions.

4. A vehicle lamp capable of repeatedly switching its light distribution pattern between a by-passing mode and a traveling mode, comprising:

a drive unit including a positioning element committed to the formation of light distribution patterns;

a first biasing member which biases the positioning element in a by-passing mode;

a meshing gear for moving the positioning element to a traveling mode position against the bias of the first biasing member and being selectively engageable with the positioning element;

a motor located on the drive unit and which supplies power to drive the meshing gear;

a second biasing member connected to the drive unit and biased to disengage the meshing gear from the positioning element; and a solenoid which selectively applies a force to the meshing gear against the bias of the second biasing member.

5. A vehicle lamp comprising:

a lamp housing;

a light source mount structure located adjacent the lamp housing and movable with respect to the lamp housing between a first position and a second position;

a driving device that is selectively engageable with the light source mount structure, wherein said driving device includes means for moving the light source mount structure with respect to the lamp housing when the driving device is engaged with the light source mount structure;

means for biasing the driving device into engagement with the light source mount structure; and means acting against the means for biasing the driving device to selectively engage the driving device with the light source mount structure.

6. The vehicle lamp of claim 5, wherein the lamp housing includes a reflector.

7. The vehicle lamp of claim 5, wherein the light source mount structure includes a light source mounting plate connected to a lever and a wheel gear.

8. The vehicle lamp of claim 5, wherein the driving device includes a motor connected to a gear.

9. The vehicle lamp of claim 5, wherein the means for selectively engaging includes a solenoid.

10. The vehicle lamp of claim 9, wherein the means for selectively engaging includes a second solenoid.

11. The vehicle lamp of claim 5, further comprising:

a first limit switch for deactivating the means for moving when the light source mount structure reaches the first position; and a second limit switch for deactivating the means for selectively engaging when the light source mount structure reaches the second position.

12. The vehicle lamp of claim 5, further comprising:

a first biasing member connected to the light source mount structure to bias it towards the first position such that when the driving device is not engaged with the light source mount structure the light source mount structure is returned to the first position.

* * * * *